US007926127B2

(12) United States Patent
Barrese

(10) Patent No.: US 7,926,127 B2
(45) Date of Patent: Apr. 19, 2011

(54) CURVED SHOWER CURTAIN ROD ASSEMBLY

(75) Inventor: Charles Barrese, Huntington, NY (US)

(73) Assignee: Ex-Cell Home Fashions, Inc., New York, NY (US)

( * ) Notice: Subject to any disclaimer, the term of this patent is extended or adjusted under 35 U.S.C. 154(b) by 332 days.

(21) Appl. No.: 11/485,682

(22) Filed: Jul. 13, 2006

(65) Prior Publication Data

US 2008/0010739 A1 Jan. 17, 2008

(51) Int. Cl.
*A47K 3/00* (2006.01)

(52) U.S. Cl. ..... 4/610

(58) Field of Classification Search ..... 4/610, 557, 4/558, 607, 608
See application file for complete search history.

(56) References Cited

U.S. PATENT DOCUMENTS

| | | | | |
|---|---|---|---|---|
| 2,778,030 | A | 1/1957 | Goche | |
| 3,107,361 | A | 10/1963 | Glutting, Sr. | |
| 3,557,390 | A | 1/1971 | Ruggles of al. | |
| 4,117,557 | A * | 10/1978 | McPeak et al. | 4/610 |
| 4,754,504 | A * | 7/1988 | Cellini | 4/610 |
| 5,022,104 | A * | 6/1991 | Miller | 4/558 |
| 5,103,531 | A | 4/1992 | Perrotta | |
| D379,297 | S * | 5/1997 | Shires | D8/376 |
| 5,662,297 | A * | 9/1997 | Christensen et al. | 211/105.1 |
| D397,928 | S | 9/1998 | Wise | |
| D426,142 | S | 6/2000 | Moore | |
| 6,216,287 | B1 * | 4/2001 | Wise | 4/610 |
| 6,263,523 | B1 | 7/2001 | Moore | |
| D483,251 | S | 12/2003 | Suero, Jr. | |
| 7,076,815 | B2 * | 7/2006 | Orpilla | 4/558 |
| D542,897 | S * | 5/2007 | Harwanko | D23/304 |
| 2005/0268394 | A1 * | 12/2005 | Monk et al. | 4/558 |
| 2006/0096023 | A1 * | 5/2006 | Dewees | 4/558 |
| 2007/0006377 | A1 * | 1/2007 | Moore | 4/558 |

* cited by examiner

*Primary Examiner* — Huyen Le
*Assistant Examiner* — Charles E Phillips
(74) *Attorney, Agent, or Firm* — Alston & Bird LLP

(57) ABSTRACT

The shower curtain rod assembly is adapted to be mounted between opposing surfaces of a shower enclosure. The assembly includes a rod with a two-part arcuate main section extending between first and second spaced, substantially parallel side sections. First and second mounting brackets are provided to engage the side sections and to secure the side sections to the respective shower curtain surfaces. Each of the brackets includes a body defining channel means for removably receiving a side section and a plate for mounting the body to a shower enclosure surface.

29 Claims, 2 Drawing Sheets

CURVED SHOWER CURTAIN ROD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to shower curtain rods and more particularly to a shower curtain rod assembly with an arcuate main section adapted for use in a shower enclosure over a bath tub having a curved wall to provide additional space for the individual taking a shower.

2. Description of Prior Art Including Information Disclosed Under 37 CFR 1.97 and 1.98

Combination showers and bath tubs are widely utilized to save space. However, they have the disadvantage of according limited room for the individual showering because the shower curtain bottom must be situated within the tube to contain the water from the shower head and thus the shower curtain is normally linear and is situated directed over the edge of the tube and the horizontal tub deck.

It is known to utilize shower curtain rods with main section that are other than linear to expand the shower space. However, some conventional rods of that type are formed of rods with multiple bends and hence are expensive to manufacture, do not provide for smooth shower curtain movement, are not aesthetically pleasing in appearance and/or require specialized mounting apparatus. Others are formed of single part making them expensive to package and ship. Still others require complicated swivel mounting brackets to accommodate angular side sections. The present invention overcomes all of those disadvantages in that it is relatively inexpensive to fabricate, package and ship, is aesthetically pleasing with a smooth arcuate main section that promotes easy shower curtain movement and utilizes simple, easy to install mounting brackets.

It is, therefore, a prime object of the present invention to provide a curved shower curtain rod assembly for expanding the space in a shower in which the rods has a minimum of bends so as to facilitate smooth shower movement.

It is another object of the present invention to provide a curved shower curtain rod assembly that is inexpensive to fabricate.

It is another object of the present invention to provide a curved shower curtain rod assembly that is aesthetically pleasing in appearance.

It is another object of the present invention to provide a curved shower curtain rod assembly that does not require complicated or moveable mounting brackets.

It is another object of the present invention to provide a curved shower curtain rod assembly that includes a two-piece rod that can be separated to make it easy and inexpensive to package and ship.

It is another object of the present invention to provide a curved shower curtain rod assembly that utilizes simple, easy to install mounting brackets.

BRIEF SUMMARY OF THE INVENTION

In accordance with one aspect of the present invention, a shower curtain rod assembly is provided that is adapted to be mounted between opposing surfaces of a shower enclosure. The assembly includes a rod having an arcuate main section extending between first and second spaced, substantially parallel side sections. First and second mounting brackets are provided to engage the side sections and secure the side sections to the respective shower enclosure surfaces.

The brackets secure the side sections to the respective shower enclosure surfaces in a removable manner. Each of the brackets has a body with a channel adapted to receive one of the side sections therein. The channels in the brackets constitute a means for removably receiving a side section.

Preferably, each of the side sections has a generally cylindrical cross-sectional configuration. The receiving means may take the form of a body with a tubular section adapted to receive the side section therein.

The bracket includes a part for mounting the body to a shower enclosure surface. Preferably, means are provided for maintaining the body in a single rotational position relative to the part.

A cover for the mounting part is also included, as are means for removably mounting the cover on the mounting part.

Preferably, the main section of the rod includes at least two parts. Means are provided for interlocking the parts of the main section of the rod.

In accordance with another object of the present invention, a shower curtain rod assembly adapted to be mounted between opposing surfaces of a shower enclosure is provided. The assembly includes a rod with a two-part arcuate main section extending between first and second space, substantially parallel side sections. First and second mounting brackets are provided to engage the side sections and to secure the side sections to the respective shower curtain surfaces. Each of the brackets includes a body defining means for removably receiving a side section and a part for mounting the body to a shower enclosure surface.

The assembly also includes a cover for the mounting part and means for removably mounting the cover on the mounting part.

Preferably, the rod also includes means for interlocking the parts of the main section of the rod.

BRIEF DESCRIPTION OF THE SEVERAL VIEWS OF DRAWINGS

To these and to such other objects that may hereinafter appears, the present invention relates to curved shower curtain rod assembly as described in detail in the following specification and recited in the annexed claims, taken together with the accompanying drawings, in which like numerals refer to like parts and in which:

DETAILED DESCRIPTION OF THE INVENTION

Figure 1:
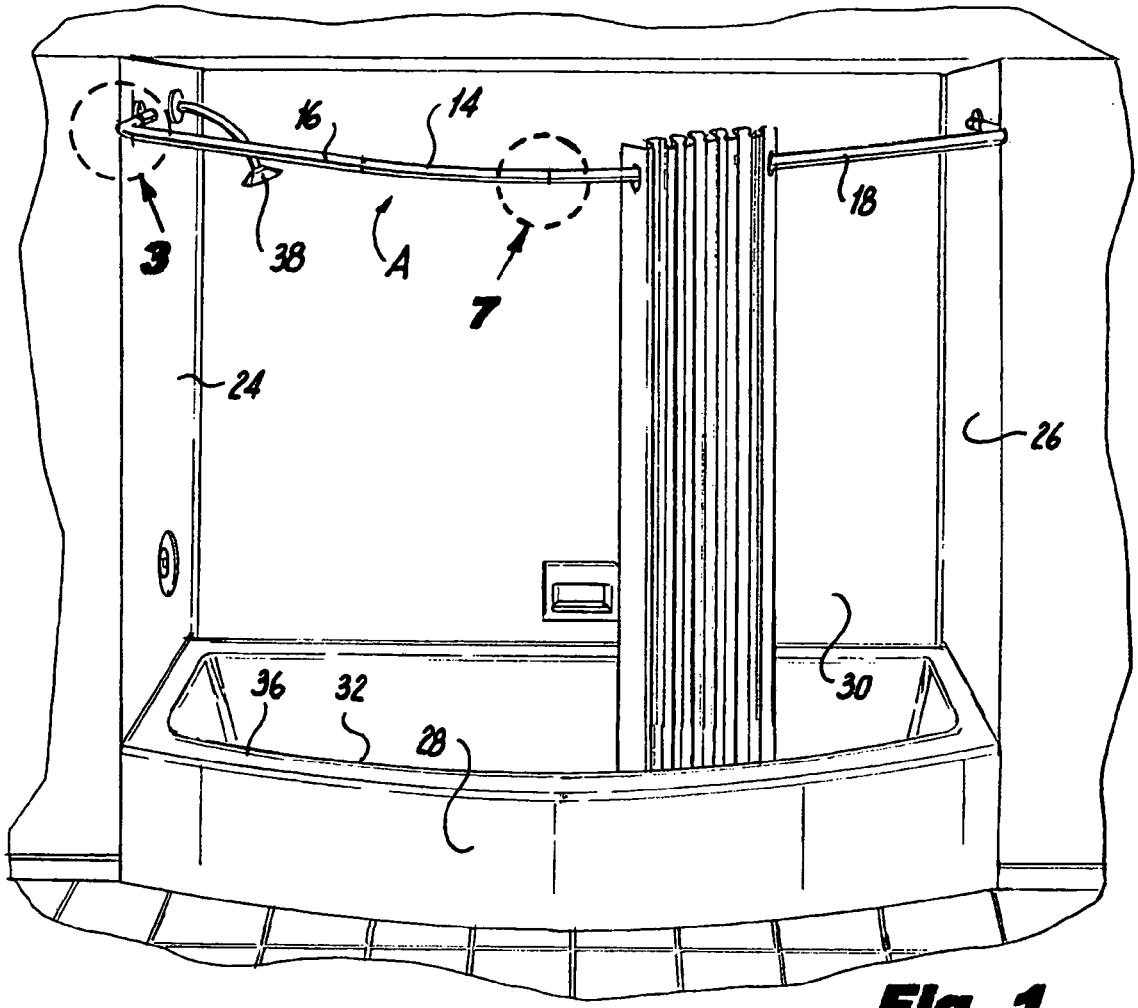
FIG. 1 is an environmental view showing the shower curtain rod assembly of the present invention as it would appear mounted in a shower enclosure.
Figure 2:
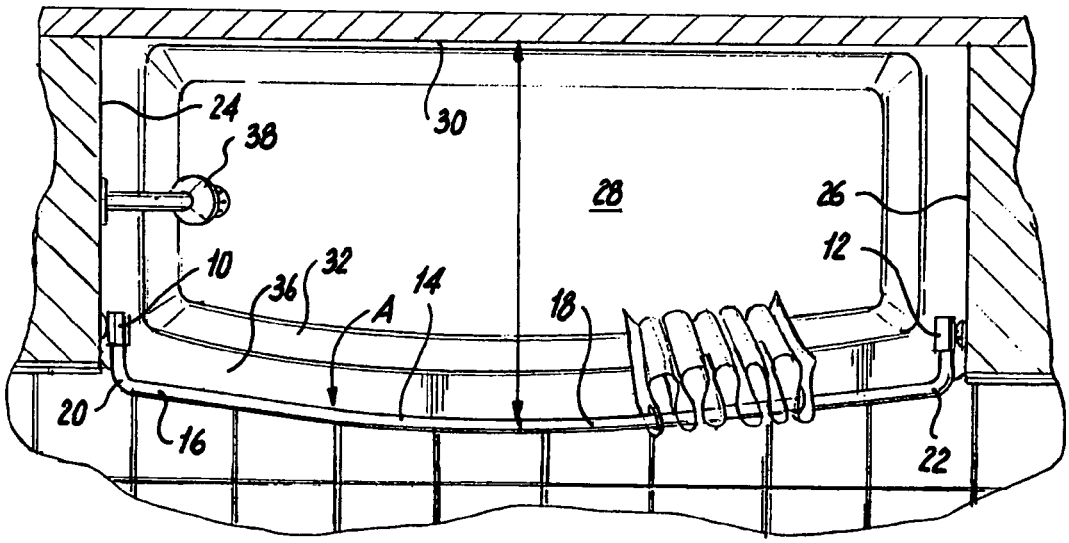
FIG. 2 is a top view of the shower enclosure shown in FIG. 1.
Figure 3:
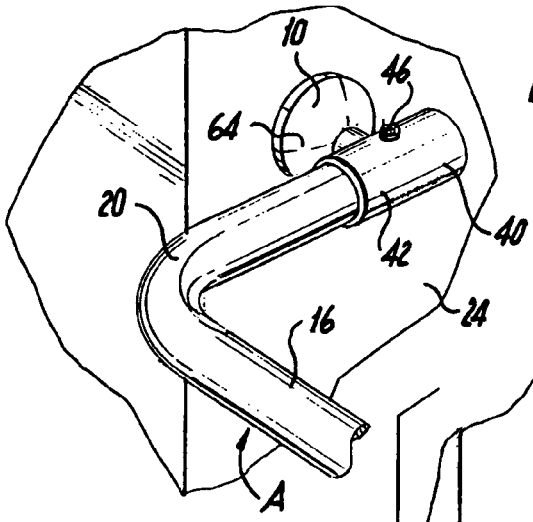
FIG. 3 is an isometric view of the mounting bracket.
Figure 5:
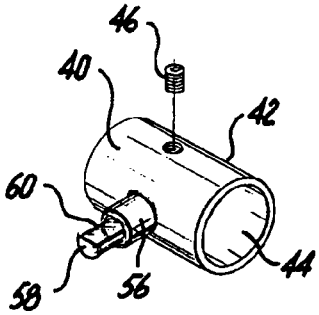
FIG. 5 is an exploded isometric view of the body portion of the mounting bracket.
Figure 4:
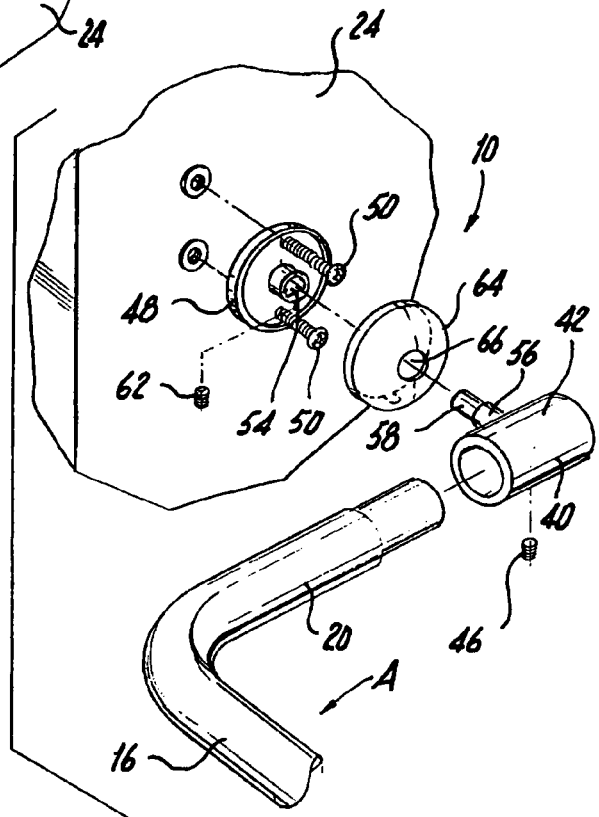
FIG. 4 is an exploded isometric view of the mounting bracket.
Figure 6:
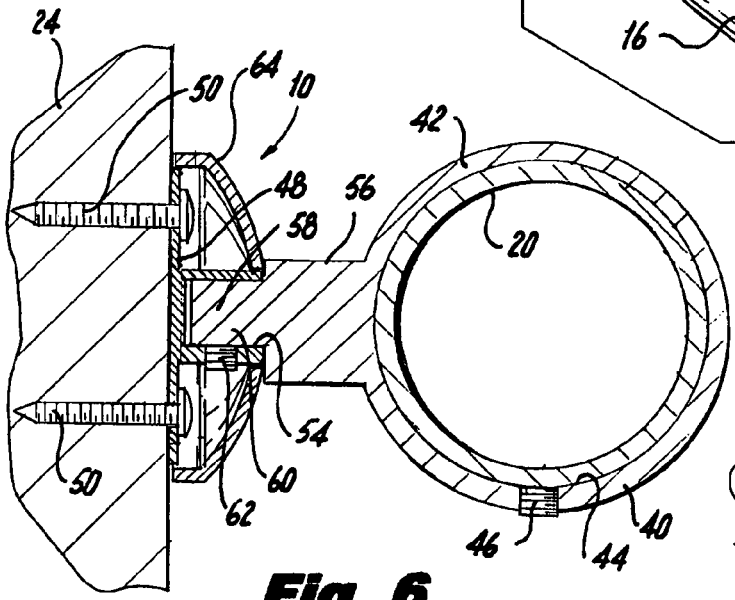
FIG. 6 is an enlarged cross-sectional view of the mounting bracket showing the side section of the rod received therein.

As seen in FIGS. 1 and 2, the curved shower curtain rod assembly of the present invention includes a rod, generally designated A, and first and second mounting brackets 10, 12. Rod A includes an arcuate main section 14 formed of first and second parts 16, 18. It also includes first and second substantially parallel side sections 20, 22 extending from said first and second main section parts 16, 18, respectively. Each of the side sections 20, 22 forms an angle of slightly more than 90 degrees with the main section part 16, 18 from which it extends.

FIG. 2 illustrates that rod A is mounted between opposing shower curtain surfaces 24, 26 at a location above tub 28 but spaced from the back wall 30 of the enclosure a distance greater than the distance between back wall 30 and the corner 32 of the tub formed by the front vertical tub wall 34 and the front deck 36 of the tub. This provides extra space for the user of the shower as compared to a conventional linear rod but still permits the bottom portion of the shower curtain, generally designated B, to be situated within tub 28 to contain the water from the shower nozzle 38.

Figure 7:
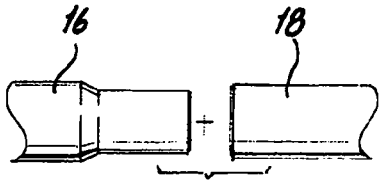
FIG. 7 is an exploded plan view of the mid-section of the rod showing the part interlocking means.

The main section 14 of rod A is arcuate, having a gentle curve that preferably approximates the curve of front wall 34 of tub 28. As seen in FIG. 7, the parts 16, 18 of the main section 14 of the rod are joined together at the mid-portion of the main section by interlocking means in the form of a reduced diameter portion forming the end of part 16 that is adapted to fit within and frictionally engage the hollow portion of the end of part 18.

FIGS. 3 through 6 illustrate one of the mounting brackets 10, 12, the other mounting bracket having essentially the same structure. The bracket includes a body 40 in the form of a hollow tubular section 42 that defines a channel 44 into which side section 20 is adapted to be removably received. Once properly positioned within channel 44, the side section is fixed to body 40 by a set screw 46.

The mounting bracket also includes a circular mounting plate 48 with openings to receive screws 50 for fixing the plate to the shower enclosure wall. Extending from the central portion of plate 50 is a hollow collar 52. The hollow inside of collar 52 is not entirely circular, but instead includes a flat surface 54.

Extending from body 40 is a protrusion having a cylindrical section 56 with an outer diameter approximately equal to the outer diameter of collar 52 and a partially cylindrical, smaller diameter section 58 with a flat surface 60. Section 56 is adapted to be received within collar 52 with surface 60 adjacent surface 54 and thus in only a single rotational position relative to plate 48. In this manner, body 40 is "keyed" to the mounting plate so as to retain the side sections and the main section of the rod in a horizontal plane. Section 58 of the protrusion is locked within collar 52 by a set screw 62 that is adapted to bear against surface 60 of the protrusion.

A cover 64 is provided to enclose plate 48. Cover has a central opening 66 with a diameter approximately equal to the outer diameter of section 58 such that is retained between collar 52 of the mounting plate and section 56 of the protrusion.

It will now be appreciated that the present invention relates to a shower curtain rod assembly adapted to be mounted between opposing surfaces of a shower enclosure. The assembly includes a rod with a two-part arcuate main section extending between first and second spaced, substantially parallel side sections. First and second mounting brackets are provided to engage the side sections and to secure the side sections to the respective shower curtain surfaces. Each of the brackets includes a body defining channel means for removably receiving a side section and a plate for mounting the body to a shower enclosure surface.

A cover is provided for the mounting plate as are means for removably mounting the cover on the mounting plate. Means for interlocking the parts of the main section of the rod are also provided.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. A shower curtain rod assembly adapted to be mounted between opposing surfaces of a shower enclosure comprising a rod having an arcuate main section extending between first and second spaced, substantially parallel side sections, and first and second mounting brackets, wherein each mounting bracket is configured to receive one of said side sections such that the side sections are substantially parallel to the shower enclosure surfaces when mounted, wherein said mounting brackets are configured to be mounted to respective shower enclosure surfaces, wherein each of said mounting brackets comprises a body and a mounting plate defining a hollow collar, wherein the body comprises a hollow tubular section configured to receive and at least partially surround an end of a respective side section and a protrusion extending substantially perpendicularly from said hollow tubular section, and wherein the hollow collar is configured to receive the protrusion such that the respective side section is fixedly engaged with and secured to the respective shower enclosure surface.

2. The assembly of claim 1 wherein said mounting brackets secure said side sections to the respective shower enclosure surfaces in a removable manner.

3. The assembly of claim 1 wherein each of said side sections has a generally cylindrical cross-sectional configuration.

4. The assembly of claim 1 further comprising a cover for said mounting plate.

5. The assembly of claim 4 further comprising means for removably mounting said cover on said mounting plate.

6. The assembly of claim 1 wherein said main section comprises at least two parts.

7. The assembly of claim 6 further comprising means for interlocking said main section parts.

8. The assembly of claim 6 wherein the at least two parts of the rod are configured to join together to form a smooth connection.

9. The assembly of claim 6 wherein the at least two parts of the rod are configured to join together at a mid-portion of the arcuate main section.

10. The assembly of claim 6 wherein an end of one of the at least two parts of the rod comprises a reduced diameter portion that is configured to be disposed within and frictionally engage an end of an other of the at least two parts of the rod.

11. The assembly of claim 6 wherein each side section is integrally formed with a respective part of the arcuate main section.

12. A shower curtain rod assembly adapted to be mounted between opposing surfaces of a shower enclosure comprising a rod having a two-part arcuate main section extending between first and second spaced, substantially parallel side sections, and first and second mounting brackets configured to be mounted to respective shower enclosure surfaces, wherein each of said mounting brackets comprises a body and a mounting plate defining a hollow collar, wherein the body comprises a hollow tubular section configured to receive and at least partially surround an end of a respective side section and a protrusion extending substantially perpendicularly from said hollow tubular section, and wherein the hollow collar is configured to receive the protrusion such that the respective side section is fixedly engaged with and secured to the respective shower enclosure surface and the side sections are substantially parallel to the opposing surfaces of the shower enclosure when mounted.

13. The assembly of claim 12 wherein the two parts of the arcuate main section are configured to join together such that a smooth connection is formed.

14. The assembly of claim 12 wherein each side section is integrally formed with a respective part of the two-part arcuate main section.

15. The assembly of claim 12 wherein an end of one part of the two-part arcuate main section comprises a reduced diameter portion that is configured to be disposed within and frictionally engage an end of the other of the two-part arcuate main section.

16. The assembly of claim 1 further comprising means for maintaining said body of the mounting bracket in a single rotational position relative to the mounting plate.

17. The assembly of claim 1 further comprising a cover, wherein the cover defines a central opening configured to receive the protrusion such that the cover is retained between the circular mounting plate and the hollow tubular section.

18. The assembly of claim 17, wherein the mounting plate defines openings each configured to receive a screw, wherein the openings are positioned such that the cover substantially hides the openings and the screws.

19. The assembly of claim 1, wherein the mounting plate is circular.

20. The assembly of claim 12 wherein the two parts of the arcuate main section are configured to join together at a mid-portion of the arcuate main section.

21. The assembly of claim 12 further comprising a cover for said mounting plate.

22. The assembly of claim 21 further comprising means for removably mounting said cover on said mounting plate.

23. The assembly of claim 12 further comprising means for interlocking said main section parts.

24. The assembly of claim 12 further comprising means for maintaining said body of the mounting bracket in a single rotational position relative to the mounting plate.

25. The assembly of claim 12, wherein the mounting plate is circular.

26. A shower curtain rod assembly configured to be mounted between opposing surfaces of a shower enclosure comprising:

a rod having an arcuate main section extending between first and second spaced, substantially parallel side sections; and first and second mounting brackets, each mounting bracket comprising a body and a mounting plate, wherein the body of each mounting bracket comprises a hollow tubular section configured to receive and at least partially surround an end of a respective side section and a protrusion extending substantially perpendicularly from said hollow tubular section, and wherein the mounting plate defines a hollow collar configured to receive the protrusion such that the respective side section is fixedly engaged with and secured to the respective shower enclosure surface and is substantially parallel to the shower enclosure surfaces when mounted to the respective shower enclosure surface.

27. The assembly of claim 26 further comprising a cover, wherein the cover defines a central opening configured to receive the protrusion such that the cover is retained between the circular mounting plate and the hollow tubular section.

28. The assembly of claim 27, wherein the mounting plate defines openings each configured to receive a screw, wherein the openings are positioned such that the cover substantially hides the openings and the screws.

29. The assembly of claim 26, wherein the mounting plate is circular.

* * * * *